US005132081A

United States Patent [19]

Lee

[11] Patent Number: 5,132,081

[45] Date of Patent: Jul. 21, 1992

[54] METHOD FOR MANUFACTURING IMPREGNATED CATHODES

[75] Inventor: Kyung S. Lee, Kumi, Rep. of Korea

[73] Assignee: Goldstar Co., Ltd., Seoul, Rep. of Korea

[21] Appl. No.: 813,671

[22] Filed: Dec. 27, 1991

[30] Foreign Application Priority Data

Dec. 28, 1990 [KR] Rep. of Korea ..... 22315/1990

[51] Int. Cl.[5] ..... B22F 7/00

[52] U.S. Cl. ..... 419/9; 419/2; 419/19; 419/27; 264/60; 264/271.1

[58] Field of Search ..... 419/2, 9, 27

[56] References Cited

U.S. PATENT DOCUMENTS 3,638,062 1/1972 Beggs et al. ..... 313/337

4,223,243 9/1980 Oliver et al. ..... 313/268

*Primary Examiner*—Stephen J. Lechert, Jr.

*Attorney, Agent, or Firm*—Leonard Bloom

[57] ABSTRACT

A method for manufacturing an impregnated cathode comprising the steps of forming a porous pallet having a plurality of pores by sintering metal powder at a high temperature in a reducing atmosphere and fitting the porous pallet tightly in a cathode ring made of a metal containing an oxidizable material such as silicon, nickel or chromium. In the porous pallet, an electron radiating material is impregnated which is able to react with the oxidizable material of the cathode ring, so that an fixing between the pallet and the cathode ring is achieved by the reaction between the electron radiating material and the oxidizable material. In accordance with the method, the thickness of the cathode body can be greatly reduced, thereby enabling the performance of the impregnated cathode to be improved. Also, the manufacturing process can be simplified, thereby improving the productivity.

2 Claims, 2 Drawing Sheets

METHOD FOR MANUFACTURING IMPREGNATED CATHODES

BACKGROUND OF THE INVENTION

1. Field of the Invention

The present invention relates to a method for manufacturing impregnated cathodes, and more particularly to a method for manufacturing impregnated cathodes, which is capable of simplifying the manufacturing process and reducing the thickness of cathode.

2. Description of the Prior Art

Impregnated cathodes have been manly used in oscilloscopes which require high cathode current. Recently, they have also been applied to electron tubes which are used in televisions, since the electron tubes require a high cathode current, according to the tendency of high resolution and large screen in televisions.

Referring to FIG. 1, there is shown an example of conventional impregnated cathode constructions. As shown in the drawing, the cathode comprises a cathode body 3 including an impregnated pallet 1 radiating electrons and a cylindrical cathode ring 2 opened at upper and lower ends thereof and made of a heat-resistant molybdenum (Mo), the impregnated pallet 1 being fixedly fitted in the cathode ring 2. The impregnated pallet 1 is made by impregnating an electron radiating material being of composite oxides such as BaO, CaO, or $Al_2O_3$ into a porous pallet of a heat-resistant metal such as tungsten (W). The cathode also comprises a cylindrical cathode sleeve 4 made of a heat-resistant molybdenmum (Mo) and having a closed upper end. The cathode sleeve 4 is mounted to the cathode body 3 such that the closed upper surface is in close contact with the lower surface of the cathode body 3. Within the cathode sleeve 4, a heater 5 adapted to heat the cathode is disposed.

Now, a conventional method of making the cathode body 3 will be described, in conjunction with FIG. 2.

As shown in FIG. 2, a porous pallet 6 having a plurality of pores is formed by sintering powder of a heat-resistant metal such as tungsten at a high temperature in a reducing atmosphere and then shaping the sintered product into a pallet. Thereafter, an electron radiating material is impregnated into the pallet 6. The impregnation of the electron radiating material is accomplished by heating the electron radiating material at a high temperature in a vacuum or inert gas atmosphere to melt it, and then impregnating the melt into pores of the pallet 6 in the same atmosphere to produce the impregnated pallet 1. The impregnated pallet 1 is then fixedly fitted in the cylindrical ring 2 which was obtained by deep drawing a piece of a heat-resistant metal such as molybdenum.

The fixing between the impregnated pallet 1 and the cathode ring 2 can be accomplished by using a brazing method or a laser welding method both of which metal powder to be melted is used to be filled between the impregnated pallet 1 and the cathode ring 2.

The cathode body 3 having the above-mentioned construction is then attached to the cathode sleeve 4, to form a impregnated cathode construction shown in FIG. 1.

In the above-mentioned method, however, the thickness of the cathode is unnecessarily increased over a desired thickness, since the fixing between the impregnated pallet 1 and the cathode ring 2 is achieved by using a brazing method or a laser welding method. As a result, the cathode body 3 is undesirably thicken, thereby resulting in the lengthening of the time taken for transmitting a heat from the heater 5 to the upper surface of the cathode body 3. Due to the lengthened heat transmission time, the video producing time increases, thereby causing the performance of the impregnated cathode to be deteriorated. Also, the manufacturing process becomes complex, thereby causing the productivity to decrease. Generally, the video producing time means the period of from the turning-on time point of the heater 5 to the time point that a video appears on an electron tube screen, as an electron is radiated from the impregnated pallet 2.

SUMMARY OF THE INVENTION

Therefore, an object of the invention is to eliminate the disadvantages encountered in the prior art and to provide a method for manufacturing an impregnated cathode wherein the fixing between a cathode ring and an impregnated pallet to for a cathode body is achieved by a chemical reaction occurring between the cathode ring and the impregnated pallet, thereby capable of simplifying the manufacturing process, reducing the thickness of the cathode body and thus shortening the video producing time.

In accordance with the present invention, this object can be accomplished by providing a method of making an impregnated cathode comprising the steps of: forming a porous pallet having a plurality of pores by sintering metal powder at a high temperature in a reducing atmosphere; fitting the porous pallet tightly in a cathode ring made of a metal containing an oxidizable material; and impregnating an electron radiating material in the porous pallet, the electron radiating material being able to react with the oxidizable material of the cathode ring, so that a fixing between the pallet and the cathode ring is achieved by the reaction between the electron radiating material and the oxidizable material.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENTS

Figure 1:
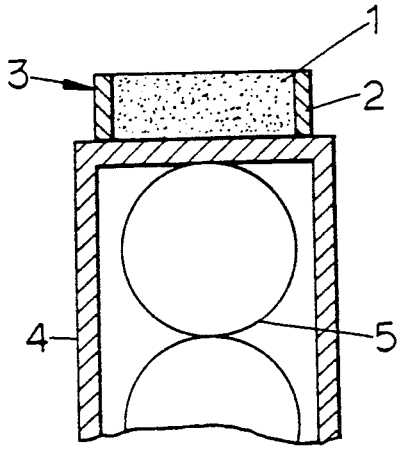
FIG. 1 PRIOR ART
FIG. 1 is a sectional view of the construction of a conventional impregnated cathode.
Figure 2:
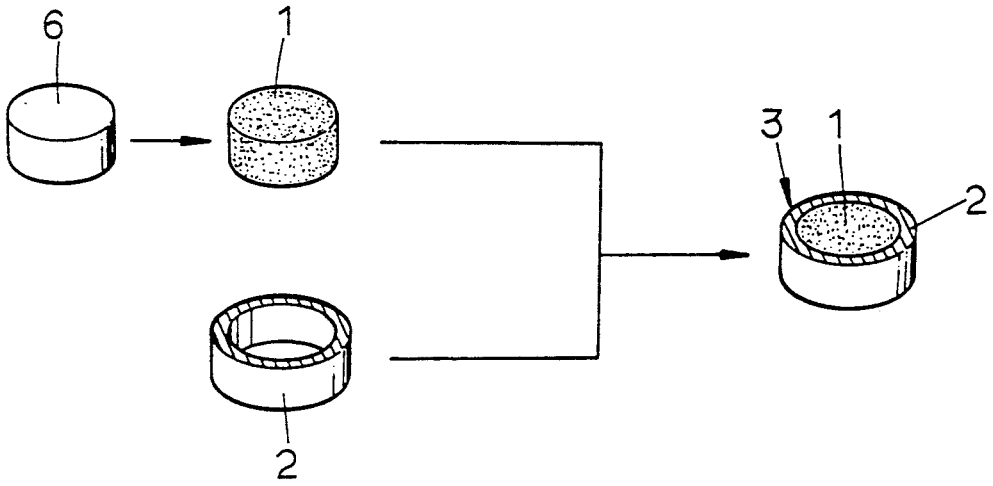
FIG. 2 PRIOR ART
FIG. 2 is a schematic view explaining a conventional method of making an impregnated cathode.
Figure 3:
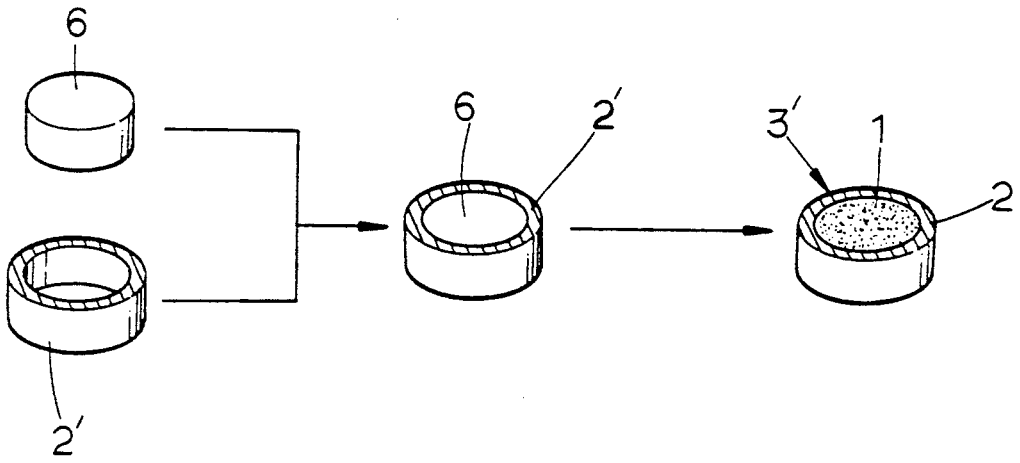
FIG. 3 is a schematic view explaining a method for manufacturing an impregnated cathode in accordance with the present invention.

Referring to FIG. 3, there is illustrated a method for manufacturing an impregnated cathode in accordance with the present invention. As shown in the drawing, a porous pallet 6 having a plurality of pores is formed by sintering powder of a heat-resistant metal such as tungsten at a high temperature in a reducing atmosphere and then shaping the sintered product into a pallet, in the same manner as in the above-mentioned conventional method. Thereafter, a cylindrical cathode ring 2' is formed by deep drawing a piece made of a metal containing oxidizable material switch readily reacts chemically with an electron radiating material and for example is silicon (Si), nickel (Ni), or chromium (Cr), or an alloy of the metal and a high heat-resistant metal. The porous pallet 6 is then tightly fitted in the cylindrical cathode ring 2'. Under the condition that the porous pallet 6 is maintained to be tightly fitted in the cylindrical cathode ring 2', an electron radiating material is impregnated into the porous pallet 6. Thus, a cathode body 3' is obtained.

The impregnation of the electron radiating material into the porous pallet 6 is accomplished by preparing the electron radiating material which is a composite oxide such as BaO or CaO formed by heating $BaCO_3$ or $CaCO_3$ at a high temperature, and then heating the electron radiating material together with an oxide such as $Al_2O_3$, at a high temperature in a vacuum or inert gas atmosphere to melt them, and then impregnating the melt into pores of the pallet 6 in the same atmosphere to produce the impregnated pallet 1.

As the electron radiating material is impregnated into the porous pallet 6 which is maintained to be tightly fitted in the cylindrical cathode ring 2' containing the oxidizable material, a strong bonding is formed between the impregnated pallet 1 and the cathode ring 2'. A fixing between the impregnated pallet 1 and the cathode ring 2' and be accomplished.

That is, the fixing between the impregnated pallet 1 and the cathode ring 2' is achieved, by virtue of a chemical reaction occurring between the electron radiating material and the oxidizable metal contained in the cathode ring 2', at the impregnation temperature of the electron radiating material metal, that is, at about 1,600° C.

If the cathode ring 2' contains silicon (Si) as its oxidizable material, the electron radiating material and the silicon of the cathode ring 2' are bonded to each other by the following reaction, during the impregnation of the electron radiating material to the porous pallet 6 to form the impregnated pallet 1.

$$BaO + Si \rightarrow Ba_2SiO_4 + 2Ba$$

$Ba_2SiO_4$ produced by the above reaction functions to bond more strongly the impregnated pallet 1 and the cathode ring 2'.

The cathode body 3' having the above-mentioned construction is then attached to a cathode sleeve 4 in which a heater 5 adapted to heat the cathode is fixedly mounted, to form an impregnated cathode construction in accordance with the present invention.

In accordance with the present invention, the cathode ring 2' has a cylindrical construction having opened ends, so as to impregnate readily the electron radiating material into the porous pallet 6. As the oxidizable material contained in the cathode ring 2', various materials can be used, so far as they can be bonded with oxygen at the temperature of no more than about 1,600° C. that is the impregnation temperature of the electron radiating material melt such as silicon, nickel or chromium. It is preferable to use an alloy with a heat-resistant metal such as molybdenum, so as to increase the hot strength.

As apparent from the above description, the present invention provides a method for manufacturing an impregnated cathode, which is capable of eliminating a brazing process or a laser welding process which is required for fixing an impregnated pallet and a cathode ring together in the prior art. As a result, the thickness of the cathode body can be greatly reduced, thereby enabling the performance of the impregnated cathode to be improved. Also, the manufacturing process can be simplified, thereby improving the productivity.

Although the preferred embodiments of the invention have been disclosed for illustrate purpose, those skilled in the art will appreciate that various modifications, additions and substitutions are possible, without departing from the scope and spirit of the invention as disclosed in the accompanying claims.

What is claimed is:

1. A method for manufacturing an impregnated cathode, comprising the steps of:

forming a porous pallet having a plurality of process by sintering metal powder at a high temperature in a reducing atmosphere;

fitting the porous pallet tightly in a cathode ring made of a metal containing an oxidizable material; and impregnating an electron radiating material into the porous pallet, the electron radiating material being able to react with the oxidizable material of the cathode ring, so that a fixing between the pallet and the cathode ring is achieved by the reaction between the electron radiating material and the oxidizable material.

2. A method in accordance with claim 1, wherein the oxidizable material is silicon, nickel or chromium.

* * * * *